US009275845B2

(12) United States Patent
Matsumoto et al.

(10) Patent No.: US 9,275,845 B2
(45) Date of Patent: Mar. 1, 2016

(54) CERAMIC METAL HALIDE LAMP HAVING DYSPROSIUM IODIDE

(71) Applicant: Iwasaki Electric Co., Ltd., Tokyo (JP)

(72) Inventors: Yasuhisa Matsumoto, Gyoda (JP); Yasushi Sasai, Gyoda (JP); Akiyoshi Maehara, Gyoda (JP)

(73) Assignee: Iwasaki Electric Co., Ltd. (JP)

( * ) Notice: Subject to any disclaimer, the term of this patent is extended or adjusted under 35 U.S.C. 154(b) by 0 days.

(21) Appl. No.: 14/021,457

(22) Filed: Sep. 9, 2013

(65) Prior Publication Data

US 2014/0077694 A1 Mar. 20, 2014

(30) Foreign Application Priority Data

Sep. 18, 2012 (JP) ..... 2012-205098

(51) Int. Cl.

| | |
|---|---|
| ***H01J 17/20*** | (2012.01) |
| ***H01J 61/18*** | (2006.01) |
| ***H01J 61/12*** | (2006.01) |
| ***H01J 61/34*** | (2006.01) |
| ***H01J 61/82*** | (2006.01) |

(52) U.S. Cl.

CPC ..... *H01J 61/125* (2013.01); *H01J 61/34* (2013.01); *H01J 61/827* (2013.01)

(58) Field of Classification Search

CPC ..... H01J 61/12; H01J 61/125; H01J 61/82; H01J 61/827; H01J 61/34

USPC ..... 313/636, 637, 638, 571, 575, 576, 313/639–643

See application file for complete search history.

(56) References Cited

U.S. PATENT DOCUMENTS

| | | | | |
|---|---|---|---|---|
| 6,069,456 | A * | 5/2000 | Fromm et al. | 315/248 |
| 7,977,886 | B2 * | 7/2011 | Tsuda et al. | 313/637 |
| 8,564,200 | B2 * | 10/2013 | Vrugt et al. | 313/638 |
| 2002/0185973 | A1 * | 12/2002 | Jackson | H01J 61/0732 313/607 |
| 2004/0189212 | A1 * | 9/2004 | Ashida et al. | 315/97 |
| 2007/0253203 | A1 * | 11/2007 | Kubon et al. | 362/296 |
| 2008/0018254 | A1 * | 1/2008 | Rahmane et al. | 313/638 |
| 2010/0060165 | A1 * | 3/2010 | Vrugt et al. | 313/623 |
| 2010/0066269 | A1 * | 3/2010 | Luijks et al. | 315/294 |
| 2012/0056534 | A1 | 3/2012 | Deng | |
| 2012/0161623 | A1 * | 6/2012 | Panyik et al. | 313/638 |

FOREIGN PATENT DOCUMENTS

| | | | |
|---|---|---|---|
| JP | 2004288617 | A | 10/2004 |
| JP | 2004349242 | A | 12/2004 |
| JP | 2012059702 | A | 3/2012 |

* cited by examiner

*Primary Examiner* — Anh Mai
*Assistant Examiner* — Glenn Zimmerman
(74) *Attorney, Agent, or Firm* — Lerner, David, Littenberg, Krumholz & Mentlik, LLP

(57) ABSTRACT

A ceramic metal-halide lamp is provided that can improve both lamp efficacy and color characteristics, and in which light color shift from the white region can be prevented when the lamp is dimmed. The lamp includes a luminous material, which contains sodium iodide (NaI), cerium iodide ($CeI_3$), thallium iodide (TlI), dysprosium iodide ($DyI_3$) and indium iodide (InI). The amount D[$DyI_3$] of dysprosium iodide $DyI_3$ is selected so as to fall within a range of 0.07 mg/cm$^3$≤D[$DyI_3$]≤1.53 mg/cm$^3$ and a weight ratio R[InI/TlI] of indium iodide InI relative to thallium iodide TlI contained in the luminous material is selected to so as to fall within a range of 0<R[InI/TlI]≤0.23.

6 Claims, 7 Drawing Sheets

CERAMIC METAL HALIDE LAMP HAVING DYSPROSIUM IODIDE

CROSS REFERENCE TO RELATED APPLICATIONS

The present application claims the benefit of and priority to JP Application No. 2012-205098, filed Sep. 18, 2012, the entire disclosure of which is incorporated by reference herein.

TECHNICAL FIELD

The present invention relates to a high-intensity discharge lamp and particularly to a ceramic metal-halide lamp.

BACKGROUND ART

Mercury lamps, sodium lamps, metal-halide lamps and ceramic metal-halide lamps are known as high-intensity discharge lamps. Metal-halide lamps use metal halides as luminous materials and therefore are not only high in lamp efficacy (or luminous efficacy) but also excellent in color characteristics such as correlated color temperature, chromaticity deviation and color rendering property. While metal-halide lamps include discharge tubes made of quartz glass, ceramic metal-halide lamps include discharge tubes made of translucent ceramics. Therefore ceramic metal-halide lamps are not only excellent in lamp efficacy and color characteristics but also long in lamp life and high in stability.

In general, it is said that ceramic metal-halide lamps suffer from an incompatible relation between lamp efficacy and color characteristics and it is difficult to obtain both high lamp efficacy and excellent color characteristics in ceramic metal-halide lamps. That is, improvement of lamp efficacy tends to deteriorate color characteristics and improvement of color characteristics tends to deteriorate lamp efficacy.

CITATION LIST

Patent Literature

[Patent Literature 1]
Japanese Patent No. 4279122 (Japanese Unexamined Patent Publication No. 2004-288617)
[Patent Literature 2]
Japanese Patent No. 4340170 (Japanese Unexamined Patent Publication No. 2004-349242)
[Patent Literature 3]
Japanese Unexamined Patent Publication No. 2012-59702

SUMMARY OF INVENTION

Technical Problem

Recently, since it is requested to reduce power consumption and to save energy, it has been customary that high-intensity discharge lamps are dimmed (dimming). Dimming of the lamps is such one that high-intensity discharge lamps are operated at electric power lower than a rated power, for example, at 70% of a rated power, 50% of a rated power, etc. Although power consumption can be reduced by dimming the lamp, a temperature within the discharge tube becomes lower than that when the lamp is operated at a rated power, thereby giving rise to a problem such that color of light is shifted from the white region. That is, although the high-intensity discharge lamp generates white light when it is operated at a rated power, such a phenomenon occurs that the high-intensity discharge lamp generates light of a particular color when it is dimmed. This phenomenon arises due to different saturated vapor pressures of a plurality of different luminous materials sealed in the discharge tube.

In order to avoid such light color shift from the white region, it is proposed that luminous materials which cause light color shift from the white region should not be used. However, if the high-intensity discharge lamp does not use those luminous materials, it is then possible that other undesirable phenomena such as deteriorations of lamp efficacy and color characteristics will occur.

It is an object of the present invention to provide a ceramic metal-halide lamp in which both lamp efficacy and color characteristics such as correlated color temperature, chromaticity deviation and color rendering property can be improved and in which light color shift from the white region can be prevented when it is dimmed.

Solution to Problem

In order to make a high-intensity discharge lamp with both excellent lamp efficacy and color characteristics and in which color shift from the white region can be prevented when the lamp is dimmed, the inventors of the present application have earnestly studied discharge tubes and luminous materials sealed in these discharge tubes. Since in a high-intensity discharge lamp, a high lamp efficacy is requested, it is customary that the high-intensity discharge lamp uses thallium Tl as a luminous material. However, thallium Tl has a luminescence peak in the green region (region with a wavelength near 535 nm) and moreover, has a higher vapor pressure than those of other luminous materials. Therefore, thallium Tl is a factor which causes light color shift to the green region when the high-intensity discharge lamp is dimmed. Accordingly, it is necessary to provide means for suppressing light color shift to the green region due to thallium Tl in a high-intensity discharge lamp.

Advantageous Effects of Invention

According to an embodiment of the invention, a ceramic metal-halide lamp including a translucent ceramic discharge tube in which a luminous material and a starting gas are sealed and a translucent outer tube for housing therein said discharge tube may be characterized in that said luminous material contains sodium iodide NaI, cerium iodide $CeI_3$, thallium iodide TlI, dysprosium iodide $DyI_3$ and indium iodide InI, assuming that $D[DyI_3]$ represents the amount of said dysprosium iodide $DyI_3$, then the amount is expressed by the following equation:

$$0.07\ \text{mg/cm}^3 \leq D[DyI_3] \leq 1.53\ \text{mg/cm}^3 \text{ and}$$

assuming that R[InI/TlI] represents a weight ratio of indium iodide InI relative to thallium iodide TlI contained in said luminous material, then said weight ratio is expressed by the following equation:

$$0 < R[InI/TlI] \leq 0.23.$$

According to an embodiment of the invention, the ceramic metal-halide lamp may be characterized in that assuming that R[InI/TlI] represents a weight ratio of indium iodide InI relative to thallium iodide TlI contained in said luminous material, then said weight ratio is expressed by the following equation:

$$0.05 \leq R[InI/TlI] \leq 0.23.$$

According to an embodiment of the invention, the ceramic metal-halide lamp may be characterized in that assuming that D[NaI] represents the amount of sodium iodide NaI, D[$CeI_3$] represents the amount of cerium iodide $CeI_3$ and D[TlI] represents thallium iodide TlI contained in said luminous material, then the amounts are expressed by the following equations:

$$0.70\ mg/cm^3 \leq D[NaI] \leq 1.73\ mg/cm^3$$

$$0.15\ mg/cm^3 \leq D[CeI_3] \leq 0.29\ mg/cm^3$$

$$0.15\ mg/cm^3 \leq D[TlI] \leq 0.26\ mg/cm^3$$

According to an embodiment of the invention, the ceramic metal-halide lamp may be characterized in that said lamp has a rated power of 100 to 400 W and said lamp has a bulb wall loading of 15 to 40 W/$cm^2$, assuming that L represents an effective length of said discharge tube and ID represents an effective inner diameter of said discharge tube, then a ratio L/ID of said effective length to said inner diameter is selected in a range of:

$$1.8 \leq L/ID \leq 2.3$$

when said lamp is operated at 70% of a rated power, the bulb wall loading of said lamp falls in a range of 10.5 to 28.0 W/$cm^2$ and when said lamp is operated at 50% of a rated power, the bulb wall loading of said lamp falls in a range of 7.5 to 20.0 W/$cm^2$.

According to an embodiment of the invention, the ceramic metal-halide lamp may be characterized in that said luminous material contains calcium iodide $CaI_2$.

According to the present invention, it is possible to provide a ceramic metal-halide lamp which can improve both lamp efficacy and color characteristics such as correlated color temperature, color deviation and color rendering property and in which light color shift from the white region can be prevented when it is dimmed.

DESCRIPTION OF EMBODIMENTS

Figure 1:
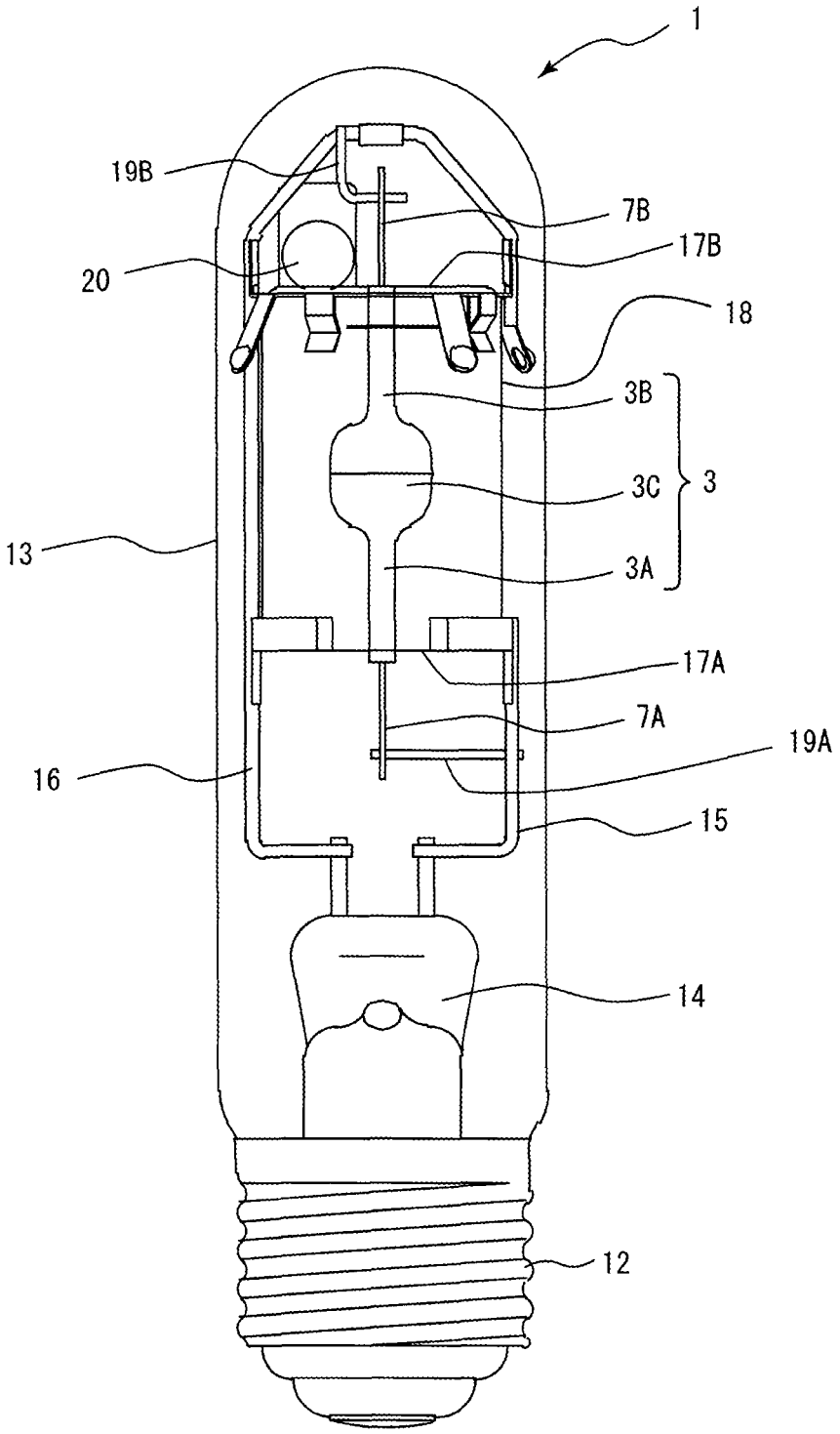
FIG. 1 is a diagram to which reference will be made in explaining an example of a high-intensity discharge lamp according to an embodiment of the present invention.

A high-intensity discharge lamp according to embodiments of the present invention will hereinafter be described with reference to the accompanying drawings. In the drawings, identical elements are marked with identical reference numerals and are not explained repeatedly.

An example of a high-intensity discharge lamp according to the present invention will be described with reference to FIGS. 1 to 3. Here, an example of a ceramic metal-halide lamp will be explained as a high-intensity discharge lamp. An example of a ceramic metal-halide lamp according to the present invention will be explained with reference to FIG. 1. A ceramic metal-halide lamp 1 according to the example of the present invention includes a discharge tube 3, a translucent sleeve 18 of a cylindrical shape disposed so as to surround the discharge tube 3 and a translucent outer tube 13 having a base 12 disposed at one end thereof. In this example, the outer tube 13 is of a T-type of a tubular shape. A nitrogen gas as an inert gas is sealed in the outer tube 13. The discharge tube 3 includes a central light-emitting portion 3C and capillaries 3A, 3B extended from respective sides of the central light-emitting portion. The structure of the discharge tube 3 will be explained with reference to FIG. 4.

Two supports 15, 16 are attached to a stem 14 of the base 12. Two support disks 17A, 17B are attached to the supports 15, 16 respectively with a predetermined space therebetween. Also, the translucent sleeve 18 is fixed to the support disks 17A, 17B and a getter 20 is attached to one support disk 17B.

Power supply lead wires 7A, 7B are projected from both ends of the capillaries 3A, 3B respectively. The power supply lead wires 7A, 7B are respectively connected to the supports 15, 16 either directly or via nickel wires 19A, 19B. In this manner, the power supply lead wires 7A, 7B extended from the respective ends of the discharge tube 3 are electrically connected to the base 12 through the supports 15, 16.

Figure 2:
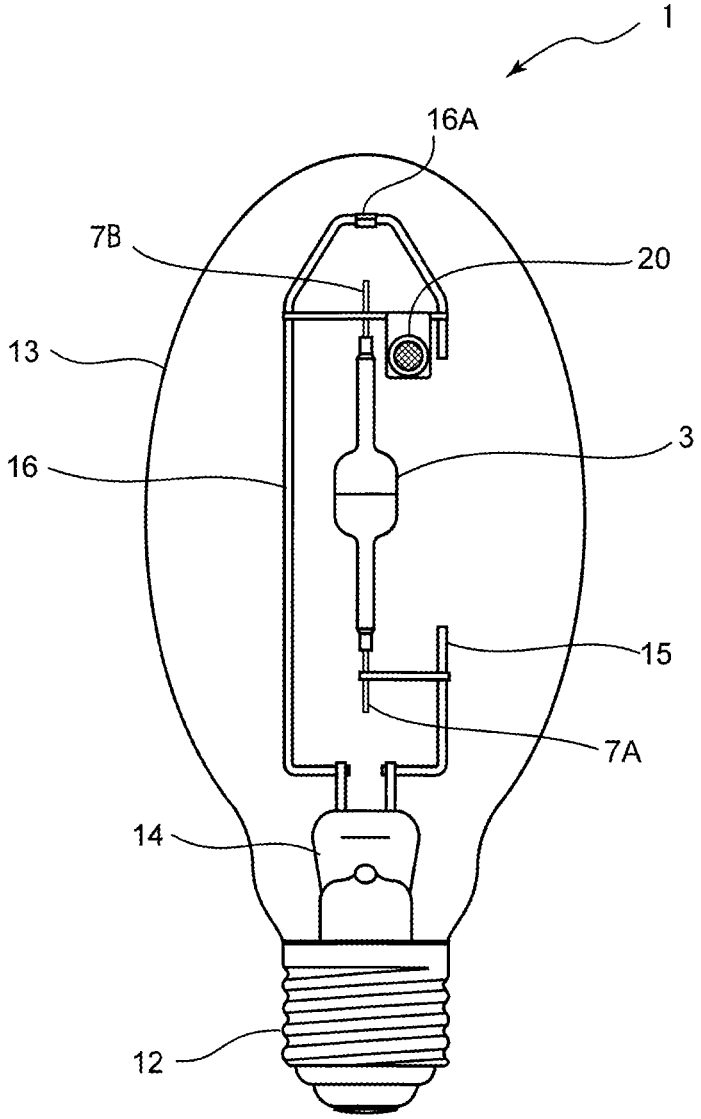
FIG. 2 is a diagram to which reference will be made in explaining another example of a high-intensity discharge lamp according to an embodiment of the present invention.

With reference to FIG. 2, another example of a ceramic metal-halide lamp according to the present invention will be described. The ceramic metal-halide lamp 1 according to this embodiment includes a discharge tube 3 and an outer tube 13 having a base 12 disposed at one end thereof. In this example, the outer tube 13 is of a B-type of a spheroid shape. Two supports 15, 16 are attached to the stem 14 of the base 12. To one support 16, a mount support plate 16A and a getter 20 are attached.

Power supply lead wires 7A, 7B are projected from both ends of the discharge tube 3. The power supply lead wires 7A, 7B are connected to the supports 15, 16, respectively. In this manner, the power supply lead wires 7A, 7B extended from the respective ends of the discharge tube 3 are electrically connected to the base 12 through the supports 15, 16.

Figure 3:
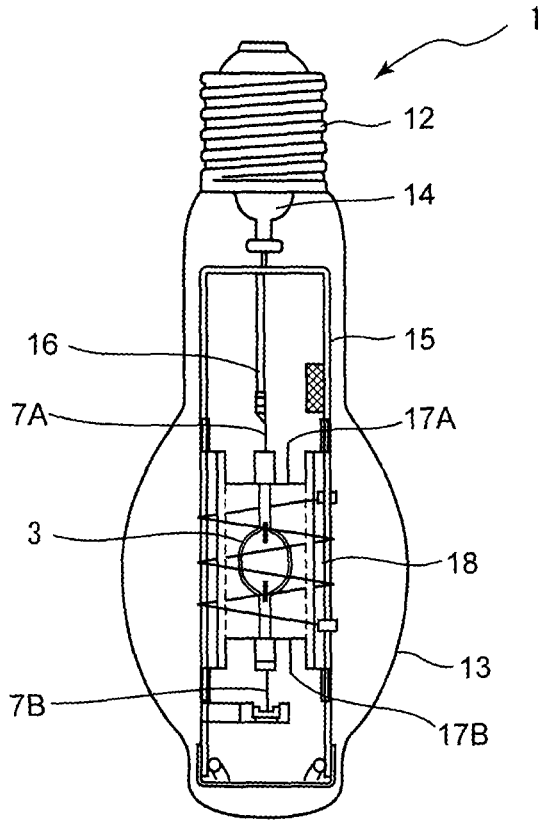
FIG. 3 is a diagram to which reference will be made in explaining a further example of a high-intensity discharge lamp according to an embodiment of the present invention.

With reference to FIG. 3, a further example of a ceramic metal-halide lamp according to the present invention will be described. The ceramic metal-halide lamp 1 according to this example includes a translucent outer tube 13 having a base 12 formed on one end thereof, a discharge tube 3 located in the inside of the translucent outer tube and a translucent sleeve 18 of cylindrical shape located so as to surround the discharge tube 3. Supports 15, 16 are attached to the stem 14 of the base 12. Support disks 17A, 17B are attached to the support 15. A translucent sleeve 18 is secured to the support disks 17A, 17B.

Power supply lead wires 7A, 7B are projected from the respective ends of the discharge tube 3. The power supply lead wires 7A, 7B are connected to the supports 15, 16, respectively.

While the high-intensity discharge lamps according to the present invention shown in FIGS. 1 to 3 include a translucent outer tube 13 having a base formed on one end thereof, the present invention is not limited to such a structure and a high-intensity discharge lamp according to the present invention may include a translucent outer tube having bases formed on respective ends thereof.

Figure 4:
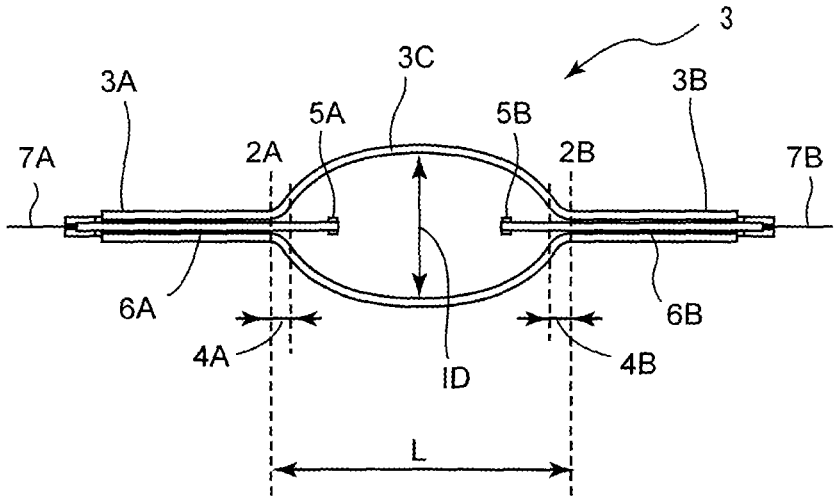
FIG. 4 is a diagram to which reference will be made in explaining an example of a discharge tube for use with a high-intensity discharge lamp according to an embodiment of the present invention.

With reference to FIG. 4, a structure of the discharge tube 3 of the metal-halide lamp according to the embodiment of the present invention will be described. The discharge tube 3 includes a central light-emitting portion 3C and a pair of capillaries 3A, 3B extended from respective end sides of the central light-emitting portion. The light-emitting portion 3C according to this embodiment is formed substantially as a spheroid shape. Two electrode assemblies 6A, 6B are inserted into the capillaries 3A, 3B respectively. The electrode assemblies 6A, 6B have electrodes 5A, 5B provided on the inner ends thereof, respectively. The electrode assemblies have the power supply lead wires 7A, 7B connected to the outer ends thereof, respectively. The respective ends of the capillaries 3A, 3B are sealed in an air-tight fashion by a sealant such as frit-glass having an electric insulating property. Also, the electrode assemblies 6A, 6B are fixed to the predetermined positions within the capillaries 3A, 3B respectively by the above-mentioned sealant.

The portions between the light-emitting portion 3C and the capillaries 3A, 3B are formed continuously via transition curved surfaces 4A, 4B respectively and hence are shaped without corner portions. The discharge tube 3 according to this embodiment is of what might be called one-piece type in which the light-emitting portion 3C and the capillaries 3A, 3B are integrally formed by molding a powder compressed body of translucent alumina.

An effective length L and an effective inner diameter ID are defined as inner dimensions of the discharge tube 3. The effective length L is defined by a distance between positions 2A and 2B at which the inner diameters of the straight-tube like capillaries 3A, 3B begin to expand. The effective inner diameter ID is defined as a central maximum inner diameter of the light-emitting portion 3C lying between the electrodes 5A and 5B if the discharge tube 3 is of what might be called one-piece type. A ratio L/ID of the effective length L to the effective inner diameter ID of the discharge tube 3 will be hereinafter referred to as an "aspect ratio". According to the embodiment of the present invention, the discharge tube is designed in such a manner that the aspect ratio may fall within a range of $1.8 \leq L/ID \leq 2.3$.

A bulb wall loading is used as a parameter that may exert an influence on the life of the lamp and lamp efficacy. The bulb wall loading is defined as a value obtained when lamp power P [W] is divided by a whole internal area S [$cm^2$] of the light-emitting portion 3C of the discharge tube 3.

According to the embodiment of the present invention, a rated power is selected in a range from 100 to 400 W. According to this embodiment, when the metal-halide lamp of the present invention is operated at a rated power, the bulb wall loading may fall within a range of 15 to 40 $W/cm^2$. When the metal-halide lamp of the present invention is dimmed, for example, the metal-halide lamp is operated at 70% of a rated power, the bulb wall loading falls within a range of 10.5 to 28.0 $W/cm^2$. Further, when this metal-halide lamp is operated at 50% of a rated power, the bulb wall loading falls within a range of 7.5 to 20.0 $W/cm^2$.

According to the embodiment of the present invention, since the aspect ratio L/ID is selected so as to fall within a range of 1.8 to 2.3, the whole internal area S [$cm^2$] of the light-emitting portion 3C of the discharge tube 3 can be increased relatively so that the bulb wall loading can be decreased comparatively. Therefore, it is possible to realize both high lamp efficacy and high color rendering property without sacrificing the life of the lamp. Further, according to the embodiment of the present invention, since it is possible to decrease a chemical reaction rate between materials that make the inner wall surface of the light-emitting portion 3C of the discharge tube 3 and luminous materials sealed in the discharge tube, especially, rare earth metal iodides, the life of the lamp can be extended.

Temperatures at respective portions of the light-emitting portion 3C of the discharge tube 3 are determined based on the bulb wall loading, the pressure of a gas sealed in the translucent outer tube, the material of the discharge tube and the aspect ratio (L/ID) of the discharge tube. According to the embodiment of the present invention, the bulb wall loading of the discharge tube, the pressure of a gas sealed in the translucent outer tube, the material of the discharge tube and the aspect ratio (L/ID) of the discharge tube are set in such a manner that when the discharge tube is energized to produce light, a temperature at the coldest portion of the discharge tube may become higher than 800° C. and a maximum temperature of the discharge tube may become lower than 1200° C.

Mercury and metal halides serving as luminous materials and a starting gas are sealed in the discharge tube 3. While an example in which metal iodides are used as metal halides will be explained hereinafter, the present invention is not limited thereto and metal bromides may be used as metal halides. In the embodiment of the present invention, iodides of alkaline metals, iodides of alkaline rare earth metals, iodides of rare earth metals, etc. can be used as metal halides. In the embodiment of the present invention, sodium iodide NaI, calcium iodide $CaI_2$, thallium iodide TlI, dysprosium iodide $DyI_3$, indium iodide InI and cerium iodide $CeI_3$ may be used as metal halides. Amounts of these luminous materials will be described in detail later on.

In order to make a high-intensity discharge lamp with both high lamp efficacy and high color characteristics and in which light color shift from the white region can be prevented when the lamp is dimmed, the inventors of the present application have earnestly studied luminous materials sealed in a discharge tube. Since it is requested that a high-intensity discharge lamp should have high lamp efficacy, it has been customary that the high-intensity discharge lamp uses thallium Tl as a luminous material. However, thallium Tl has a luminescence peak around the green region (wavelength near 535 nm). Further, thallium has a high vapor pressure as compared with other luminous materials. For this reason, if a high-intensity discharge lamp uses thallium Tl as a luminous material, then when the lamp is dimmed, light color shift to the green region is unavoidable. Therefore, in a high-intensity discharge lamp, it is necessary to provide means for suppressing light color shift to the green region due to thallium Tl.

First, the inventors of the present application have paid attention to dysprosium Dy. Dysprosium Dy has a luminescence peak in the blue region (wavelength near 421 nm). By mixing green light induced due to thallium Tl with blue light induced due to dysprosium Dy, light color shift to the green region can be suppressed and the lamp can keep producing white light.

Further, dysprosium Dy has a continuous spectrum induced in the red region due to molecular luminescence. Accordingly, by mixing green light induced due to thallium Tl with red light induced due to dysprosium Dy, light color shift to the green region can be suppressed and the lamp can keep producing white light. That is, when an appropriate amount of dysprosium Dy is added to the discharge tube, the lamp can keep producing white light when it is dimmed and also the lamp can obtain both high lamp efficacy and high color characteristics.

Next, the inventors of the present application have paid attention to indium In. Indium In has a luminescence peak in the blue region (wavelength near 450 nm). Therefore, by mixing green light induced due to thallium Tl with blue light induced due to indium In, light color shift to the green region can be suppressed and the lamp can keep producing white light. Also, indium In has a relatively high vapor pressure. Accordingly, by selecting a ratio of indium In relative to thallium Tl to be an appropriate value, light color shift to the green region due to thallium Tl can be suppressed.

Next, the inventors of the present application have paid attention to thulium Tm. It is known that thulium Tm has a function on improving lamp efficacy and enhancing color rendering property. However, thulium Tm has a number of luminescence peaks in the blue-green region (wavelength near 450 to 530 nm). Accordingly, if the lamp uses thulium Tm as a luminous material, then light color shift to the green region due to thallium Tl will be encouraged rather than be suppressed. Therefore, the inventors of the present application have decided that the lamp should not use thulium Tm as a luminous material. Thus, since the lamp does not use thulium Tm as a luminous material, it is possible to suppress light color shift to the green region due to thallium Tl. Even when the lamp does not use thulium Tm as a luminous material, the lamp is able to maintain lamp efficacy and color rendering property by using dysprosium Dy.

In general, it is known that halides of rare earth metals such as dysprosium Dy, holmium Ho, cerium Ce, praseodymium Pr and neodymium Nd have functions on improving lamp efficacy to thereby produce white light. If a large amount of halide of rare earth metal is sealed in the discharge tube, then the halide of the rare earth metal is caused to produce a reaction product between the halide of the rare earth metal and the discharge tube, thereby causing a lumen maintenance rate to be lowered. Accordingly, it is necessary to set an appropriate amount of halide of rare earth metal in such a fashion that an excessively large amount of halide of rare earth metal should not be sealed in the discharge tube. While the embodiment of the present invention uses thallium Tl, dysprosium Dy and indium In as additives sealed in the discharge tube as described above, the additives are not limited to thallium, dysprosium and indium, and for example, halides of cerium Ce may be further used as additives in the present invention.

Next, experiments carried out by the inventors of the present application will be described. The inventors of the present application have made ceramic metal-halide lamps experimentally and have compared the thus experimentally made ceramic metal-halide lamps with a prior-art ceramic metal-halide lamp. The lamps thus experimentally made by the inventors of the present application contain at least sodium iodide NaI as a luminous material. Further, the lamps thus experimentally made by the inventors of the present application contain at least cerium iodide $CeI_3$ as a luminous material. Assuming that D[NaI] represents the amount of sodium iodide NaI and that $D[CeI_3]$ represents the amount of cerium iodide $CeI_3$, then these the amounts of sodium iodide and cerium iodide are expressed by the following equation.

$$0.70\ \text{mg/cm}^3 \leq D[\text{NaI}] \leq 1.73\ \text{mg/cm}^3$$

$$0.15\ \text{mg/cm}^3 \leq D[\text{CeI}_3] \leq 0.29\ \text{mg/cm}^3 \quad (1)$$

The inventors of the present application have examined dimming characteristics by changing luminous materials sealed in a discharge tube. First, the inventors of the present application have examined dimming characteristics by using the amount of dysprosium iodide $DyI_3$ as a parameter. Table 1 shows experimental results obtained when dimming characteristics of a prior-art lamp (lamp of prior-art example) and lamps experimentally made by the inventors of the present application (lamps of inventive examples 1 to 4) were examined. While the amount of dysprosium iodide $DyI_3$ is zero in the lamp of the prior-art example, the amounts of dysprosium iodide of the lamps of the inventive examples 1 to 4 are selected in a range of 0.07 to 0.92 mg/cm$^3$. Color temperature CCT, chromaticity deviation Duv and color rendering index CRI were measured as color characteristics when the lamps were operated at a rated power. The chromaticity deviation Duv indicates a deviation from a blackbody locus (BBL) on a chromaticity diagram. The blackbody locus (BBL) on the chromaticity diagram indicates a natural color tone given by sunlight. An equality of Duv=0 indicates the fact that chromaticity lies on the blackbody locus (BBL).

TABLE 1

| Lamp of test target | $DyI_3$ [mg/cm$^3$] | Color characteristics at rated power CCT [K] | Duv | CRI | Light color at rated power | Light color when lamp is dimmed | Light color is shifted or not when dimmed |
|---|---|---|---|---|---|---|---|
| Prior-art Example | 0 | 4040 | 13 | 81 | Slightly greenish white | Green | Shifted |
| Inventive example 1 | 0.07 | 4120 | 11 | 82 | White | White | Not shifted |
| Inventive example 2 | 0.39 | 3930 | 4 | 88 | White | White | Not shifted |
| Inventive example 3 | 0.66 | 4020 | 2 | 91 | White | White | Not shifted |

TABLE 1-continued

| Lamp of test target | $DyI_3$ [mg/cm$^3$] | Color characteristics at rated power CCT [K] | Duv | CRI | Light color at rated power | Light color when lamp is dimmed | Light color is shifted or not when dimmed |
|---|---|---|---|---|---|---|---|
| Inventive example 4 | 0.92 | 4270 | 2 | 93 | White | White | Not shifted |

As shown on table 1, according to the lamp of the prior-art example, light color was slightly greenish white when it was operated by a rated power, but light color was green when the lamp was dimmed. That is, it was observed that light color was shifted when the lamp was dimmed. According to the lamps of the inventive examples 1 to 4, light colors were white both when the lamps were operated at a rated power and when the lamps were dimmed. That is, it was observed that light color was not shifted when those lamps were dimmed. A study of these results can reveal that by adding an appropriate amount of dysprosium iodide $DyI_3$ as a luminous material, light color shift from the white region can be suppressed when the lamps were dimmed. Further, it became clear that by increasing the amount of dysprosium iodide $DyI_3$, color characteristics, in particular, the chromaticity deviation Duv and the color rendering index CRI can be improved when the lamps were operated at a rated power.

Figure 5:
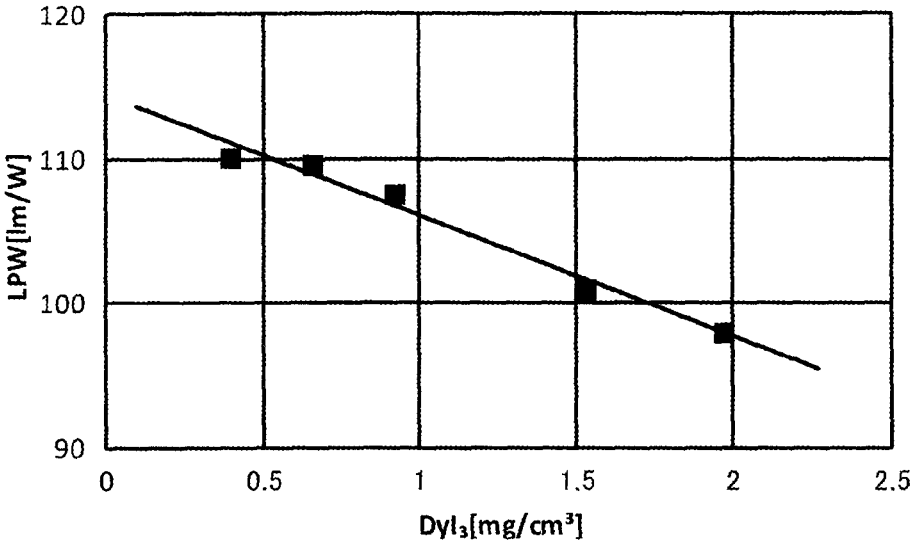
FIG. 5 is an explanatory diagram to which reference will be made in explaining a relationship between concentration of dysprosium iodide and lamp efficacy in a high-intensity discharge lamp.

With reference to FIG. 5, the inventors of the present application have examined lamp efficacy (luminous efficacy) by using the amount of dysprosium iodide $DyI_3$ as a parameter. Examined results are shown in FIG. 5. A horizontal axis represents the amount [mg/cm$^3$] of dysprosium iodide $DyI_3$ and a vertical axis represents lamp efficacy (luminous efficacy) LPW [lm/W]. A study of the measured results can reveal that the increase of the amount of the dysprosium iodide $DyI_3$ deteriorates the lamp efficacy. It has been customary that if lamp efficacy is greater than 100, such a lamp is regarded as a high efficacy lamp. Therefore, a study of the measured results on FIG. 5 can reveal that lamp efficacy becomes greater than 100 when the amount of dysprosium iodide $DyI_3$ is less than 1.53 mg/cm$^3$. Accordingly, in order to maintain high lamp efficacy and also to suppress light color shift from the white region when the lamp is dimmed, it is preferable that the amount of dysprosium iodide $DyI_3$ should be selected to be less than 1.53 mg/cm$^3$. Assuming now that $D[DyI_3]$ [mg/cm$^3$] represents the amount of dysprosium iodide $DyI_3$, then this condition is expressed by the following equation.

$$0<D[DyI_3]\leq 1.53\ \text{mg/cm}^3 \quad (2)$$

If the amount $D[DyI_3]$ of dysprosium iodide $DyI_3$ is too small, then it becomes impossible to suppress light color shift to the green region due to thallium Tl. Therefore, according to the embodiment of the present invention, based on the results of the inventive example 1 shown on table 1, it is to be understood that the amount of dysprosium iodide $DyI_3$ should be at least 0.07 mg/cm$^3$.

$$0.07\ \text{mg/cm}^3\leq D[DyI_3]\leq 1.53\ \text{mg/cm}^3 \quad (3)$$

Next, the inventors of the present application have examined dimming characteristics by using the ratio of indium iodide InI relative to thallium iodide TlI as a parameter. As described above, although it is necessary to use thallium iodide TlI as a luminous material in order to obtain high lamp efficacy, it is unavoidable that the thallium iodide causes light color shift to the green region when a lamp is dimmed. Therefore, it is necessary to set the amount of thallium iodide TlI to a proper value. Based on the results of various experiments, the inventors of the present application have set the amount of thallium iodide TlI in this embodiment. Assuming that D[TlI] [mg/cm$^3$] represents the amount of thallium iodide TlI, then the amount can be expressed by the following equation.

$$0.15\ \text{mg/cm}^3\leq D[TlI]\leq 0.26\ \text{mg/cm}^3 \quad (4)$$

Table 2 shows measured results obtained when dimming characteristics were examined by using the ratio of indium iodide InI relative to thallium iodide TlI as a parameter.

TABLE 2

| Lamp of test target | Ratio of InI/TlI [wt/wt] | Color characteristics at rated power CCT [K] | Duv | CRI | Light color at rated power | Light color when lamp is dimmed | Light color is shifted or not when lamp is dimmed |
|---|---|---|---|---|---|---|---|
| Prior-art Example | 0 | 4040 | 13 | 81 | Slightly greenish white | Green | Shifted |
| Inventive example 11 | 0.05 | 4010 | 5 | 87 | White | White | Not shifted |
| Inventive example 12 | 0.10 | 3930 | 4 | 88 | White | White | Not shifted |
| Inventive example 13 | 0.10 | 4020 | 2 | 91 | White | White | Not shifted |
| Inventive example 14 | 0.125 | 4140 | 1 | 90 | White | White | Not shifted |

A study of the results on table 2 can reveal the following. By adding an appropriate amount of indium iodide and selecting the ratio of indium iodide relative to thallium iodide to be a proper value, color characteristics, especially, chromaticity deviation Duv and color rendering index CRI can be improved when the lamp is operated at a rated power. Since even a trace of indium In sealed in a discharge tube is able to produce emission of blue bright line, it can contribute to keeping a balance between blue light emission thereof and green light emission due to thallium Tl.

Here, the specifications of the lamps of the inventive examples 11 to 14 will be described. The lamp structure is of a type which includes a translucent outer tube having a base formed at its one end and a discharge tube housed within the translucent outer tube. The discharge tube is made of translucent ceramics and the discharge tube includes capillaries disposed on respective ends thereof. Electrode assemblies are inserted into the capillaries respectively. While this lamp is of a perpendicular lighting type, this lamp can be operated at any lighting attitude.

The lamp of the present invention is operated at a rated power of 270 W. However, according to the embodiment of the present invention, a rated power of the lamp may be selected in a range of 100 to 400 W. The ratio L/ID of the effective length L [mm] to the effective inner diameter ID [mm] of the discharge tube was 1.82. Also, the bulb wall loading when the lamp is operated at a rated power is 19.2 $W/cm^2$.

The lamp may contain sodium iodide NaI, cerium iodide $CeI_3$, thallium iodide TlI, dysprosium iodide $DyI_3$ and indium iodide InI as luminous materials. Further, in order to suppress corrosion of alumina which is a material of the discharge tube, the lamp may contain calcium iodide $CaI_2$ of which amount is less than 10 mol % relative to the whole amount of luminous materials sealed in the discharge tube.

In the lamp of the prior-art example, it was observed that light color is caused to shift from the white region when the lamp is dimmed. In the inventive examples 11 to 14, it was not observed that light color is caused to shift from the white region when the lamps are dimmed. The light color shift from the white region in the inventive examples 11 to 14 will be described in detail later on.

Figure 6:
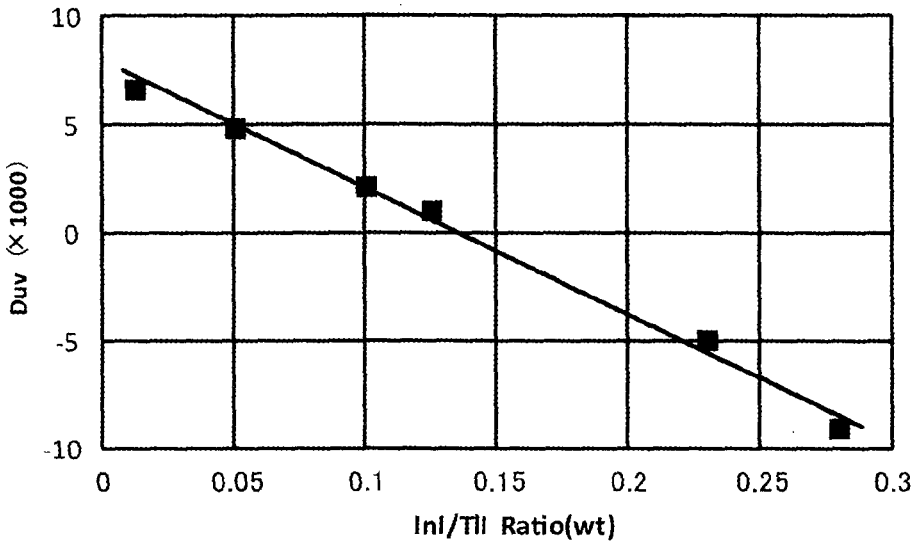
FIG. 6 is an explanatory diagram to which reference will be made in explaining a relationship between a ratio of indium iodide to thallium iodide and chromaticity deviation in a high-intensity discharge lamp.

With reference to FIG. 6, the present invention will be described. The inventors of the present application have examined chromaticity deviation Duv by using the ratio of indium iodide InI relative to thallium iodide TlI as a parameter. Examined results are shown in FIG. 6. A horizontal axis represents the ratio of indium iodide InI relative to thallium iodide TlI and a vertical axis represents chromaticity deviation Duv. As described above, it is requested that an absolute value of chromaticity deviation Duv should be made as small as possible. This absolute value of chromaticity deviation should preferably be selected to be smaller than 5. Based on the results shown in FIG. 6, in order to make the absolute value of chromaticity deviation Duv smaller than 5, the weight ratio of indium iodide InI relative to thallium iodide TlI should be selected in a range of 0.05 to 0.23. Assuming that R[InI/TlI] represents a weight ratio of indium iodide InI relative to thallium iodide TlI, then this weight ratio may be expressed by the following equation according to the embodiment of the present invention.

$$0<R[\mathrm{InI/TlI}]\leq 0.23 \quad (5)$$

More preferably, the weight ratio R[InI/TlI] should be expressed by the following equation.

$$0.05\leq R[\mathrm{InI/TlI}]\leq 0.23 \quad (6)$$

Tables 3 to 7 show results obtained by measuring lamp voltage VL [V], luminous flux Lumen [lm], lamp efficacy (luminous efficacy) LPW [lm/W], color temperature CCT [K], chromaticity deviation Duv, color rendering index CRI and stimulus values x, y on the chromaticity diagram with regard to a prior-art lamp (prior-art example) and lamps (inventive examples 11 to 14) experimentally made by the inventors of the present application while dimming conditions were being varied (100%, 70%, 50% of a rated power). The stimulus values x, y on the chromaticity diagram will be described later on with reference to FIG. 7A.

TABLE 3 lamp of the prior-art example: $DyI_3$ = 0 [$mg/cm^3$], InI/TlI (weight ratio) = 0

| Power | VL [V] | Lumen [1 m] | LPW [1 m/W] | CCT [K] | Duv | CRI | x | Y |
|---|---|---|---|---|---|---|---|---|
| Rated power | 112.7 | 31800 | 119 | 4040 | 13 | 81 | 0.388 (Δx = 0) | 0.411 (Δy = 0) |
| 70% of rated power | 98.7 | 19100 | 104 | 4220 | 20 | 69 | 0.383 (Δx = −0.005) | 0.424 (Δy = 0.013) |
| 50% of rated power | 94.3 | 10100 | 75 | 4730 | 34 | 53 | 0.365 (Δx = −0.023) | 0.445 (Δy = 0.034) |

TABLE 4 lamp of the inventive example 11: $DyI_3$ = 0.66 [$mg/cm^3$], InI/TlI (weight ratio) = 0.05

| Power | VL [V] | Lumen [1 m] | LPW [1 m/W] | CCT [K] | Duv | CRI | x | Y |
|---|---|---|---|---|---|---|---|---|
| Rated power | 113.6 | 27700 | 107 | 4010 | 5 | 87 | 0.384 (Δx = 0) | 0.389 (Δy = 0) |
| 70% of rated power | 99.7 | 17000 | 92 | 4750 | 13 | 74 | 0.357 (Δx = −0.027) | 0.388 (Δy = −0.001) |
| 50% of rated power | 94.8 | 10000 | 74 | 5810 | 24 | 61 | 0.324 (Δx = −0.060) | 0.384 (Δy = −0.005) |

TABLE 5

| lamp of the inventive example 12: $DyI_3$ = 0.39 [mg/cm$^3$], InI/TlI (weight ratio) = 0.1 | | | | | | | | |
|---|---|---|---|---|---|---|---|---|
| Power | VL [V] | Lumen [1 m] | LPW [1 m/W] | CCT [K] | Duv | CRI | X | Y |
| Rated power | 114.7 | 29600 | 110 | 3930 | 4 | 88 | 0.387 (Δx = 0) | 0.389 (Δy = 0) |
| 70% of rated power | 100.7 | 18500 | 98 | 4310 | 7 | 76 | 0.371 (Δx = −0.016) | 0.385 (Δy = −0.004) |
| 50% of rated power | 97.6 | 10400 | 75 | 5180 | 17 | 63 | 0.343 (Δx = −0.044) | 0.385 (Δy = −0.004) |

TABLE 6

| lamp of the inventive example 13: $DyI_3$ = 0.66 [mg/cm$^3$], InI/TlI (weight ratio) = 0.1 | | | | | | | | |
|---|---|---|---|---|---|---|---|---|
| Power | VL [V] | Lumen [1 m] | LPW [1 m/W] | CCT [K] | Duv | CRI | x | Y |
| Rated power | 122.7 | 29600 | 110 | 4020 | 2 | 91 | 0.381 (Δx = 0) | 0.382 (Δy = 0) |
| 70% of rated power | 106.9 | 18500 | 98 | 4390 | 5 | 79 | 0.367 (Δx = −0.014) | 0.379 (Δy = −0.003) |
| 50% of rated power | 99.6 | 10600 | 77 | 5210 | 14 | 65 | 0.341 (Δx = −0.040) | 0.378 (Δy = −0.004) |

TABLE 7

| lamp of the inventive example 14: $DyI_3$ = 0.66 [mg/cm$^3$], InI/TlI (weight ratio) = 0.125 | | | | | | | | |
|---|---|---|---|---|---|---|---|---|
| Power | VL [V] | Lumen [1 m] | LPW [1 m/W] | CCT [K] | Duv | CRI | x | Y |
| Rated power | 120.4 | 29900 | 111 | 4140 | 1 | 90 | 0.375 (Δx = 0) | 0.376 (Δy = 0) |
| 70% of rated power | 106.0 | 18300 | 97 | 4380 | 2 | 79 | 0.366 (Δx = −0.009) | 0.371 (Δy = −0.005) |
| 50% of rated power | 97.8 | 10400 | 75 | 5240 | 8 | 66 | 0.340 (Δx = −0.035) | 0.363 (Δy = −0.013) |

The following may become clear from the results on tables 3 to 7. When the lamp is operated by a rated power, the color characteristics, in particular, the chromaticity deviation Duv and the color rendering index CRI can be improved by adding appropriate amounts of dysprosium iodide $DyI_3$, thallium iodide TlI and indium iodide InI.

Eighth and ninth columns of tables 3 to 7 show measured results of the stimulus values x, y and calculated results of their deviations Δx, Δy when the lamps were operated at a rated power and when the lamps are dimmed. The deviations Δx, Δy of the stimulus values express the amount of increasing or decreasing of stimulus values x, y when the lamps are dimmed respectively based on the standard stimulus value at a rated power.

First, let us consider the deviation Δx of the stimulus value x. Values of the deviation Δx of the stimulus values x of the inventive examples 11 to 14 are sufficiently larger than those of the prior-art examples. This means that when the lamps were dimmed, the stimulus values x are changed considerably in the case of the inventive examples 11 to 14.

Next, let us consider the deviation Δy of the stimulus values y. Values of the deviation Δy of the stimulus values y of the inventive examples 11 to 14 are sufficiently smaller than those of the prior-art example. This means that the stimulus values y are scarcely changed when the lamps are dimmed in the case of the inventive examples 11 to 14. Accordingly, in the case of the inventive examples 11 to 14, dots representative of light color on the chromaticity diagram are moved substantially in parallel to the x-axis when the lamps are dimmed.

Figure 7A:
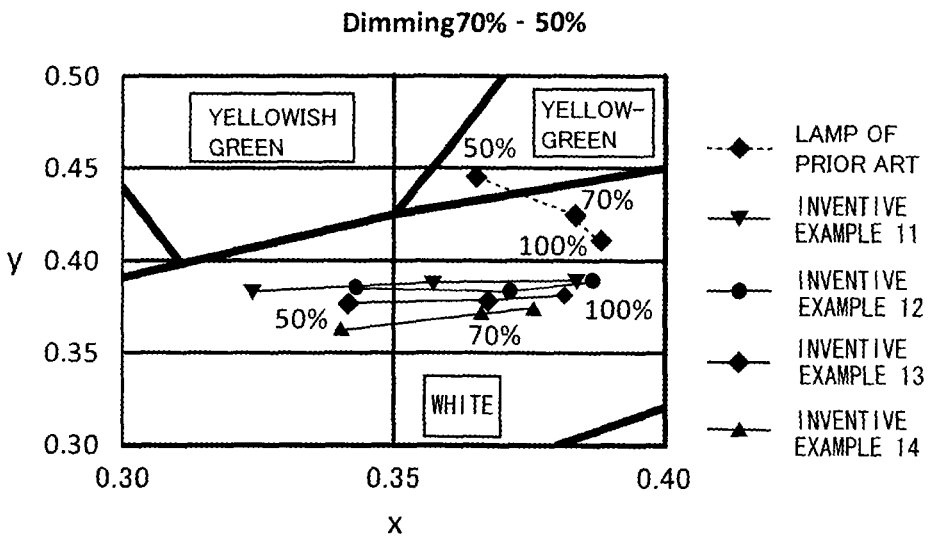
FIG. 7A is an explanatory diagram to which reference will be made in explaining an example of dimming in a high-intensity discharge lamp according to an embodiment of present invention.

FIG. 7A shows results obtained when the results of the lamp of the above-mentioned prior-art example and the lamps of the inventive examples 11 to 14 are plotted on the chromaticity diagram. FIG. 7A is a schematic diagram showing an enlarged part cut out from the chromaticity diagram. While color is expressed by tristimulus values x, y and z, the sum of tristimulus values x, y and z is 1. Therefore, if the two stimulus values x and y are determined, then the other stimulus value z is determined uniquely. A chromaticity diagram expresses plane coordinates in which a horizontal axis represents the stimulus value x and a vertical axis represents the stimulus value y. A dot on the chromaticity diagram includes a coordinate value composed of two stimulus values x and y and therefore a color includes tristimulus values x, y and z can be specified.

In the chromaticity diagram, a white region is displayed substantially at the center thereof and regions in yellow, green, blue, purple, red and orange are drawn around the white region so as to vary continuously.

FIG. 7A shows a part of the chromaticity diagram schematically depicted including a white region located substantially at the center of the chromaticity diagram, a greenish yellow region and a slightly yellowish green region, both of which are located on the upper side of the white region. Here, for convenience sake of explanation, four lines are drawn on the partial chromaticity diagram and the regions divided by these lines are assumed to be a yellowish green region, a greenish yellow region and a white region. A broken line curve on the chromaticity diagram indicates a locus of coordinate which shows light color of the lamp of the prior-art example. Solid line curves on the chromaticity diagram indicate loci of coordinates which show light colors of the lamps of the inventive examples 11 to 14.

In case of prior-art example, light color was slightly greenish white when the lamp was operated at a rated power, but in cases of the inventive examples 11 to 14, light colors were white when the lamps were operated at a rated power. That is, when the lamp of the prior-art example and the lamps of the inventive examples are operated at a rated power (100%), coordinate points indicative of light colors remain in the white region.

When the lamp of the prior-art example and the lamps of the inventive examples 11 to 14 are operated at 70% of a rated power, coordinate points indicative of light colors are moved on the chromaticity diagram. In the case of the lamp of the prior-art example, the coordinate point indicative of light color is moved in the upper left direction. However, in the case of the lamps of the inventive examples 11 to 14, coordinate points indicative of light colors are moved in the direction substantially parallel to the horizontal axis.

When the lamp of the prior-art example and the lamps of the inventive examples 11 to 14 are operated at 50% of a rated power, coordinate points indicative of light colors are further moved on the chromaticity diagram. In the case of the lamp of the prior art, the coordinate point indicative of light color is further moved in the upper left direction and thereby moved from the white region to the yellow green region. However, in the case of the lamps of the inventive examples 11 to 14, the coordinate points indicative of light colors are further moved in the direction substantially parallel to the horizontal axis. Therefore, the coordinate points indicative of light colors remain in the white region.

That is, in the lamp according to the prior-art example, when the lamp is dimmed, light color is caused to shift and is moved out from the white region. Thus, it appears as if light was colored, for example, in green. Therefore, it causes a viewer to feel that something is wrong or strange. On the other hand, although color temperatures of the lamps of the inventive examples are changed when the inventive lamps are dimmed, light colors thereof remain in the white region. Thus, a viewer may not feel subjectively that something is wrong or strange.

Figure 7B:
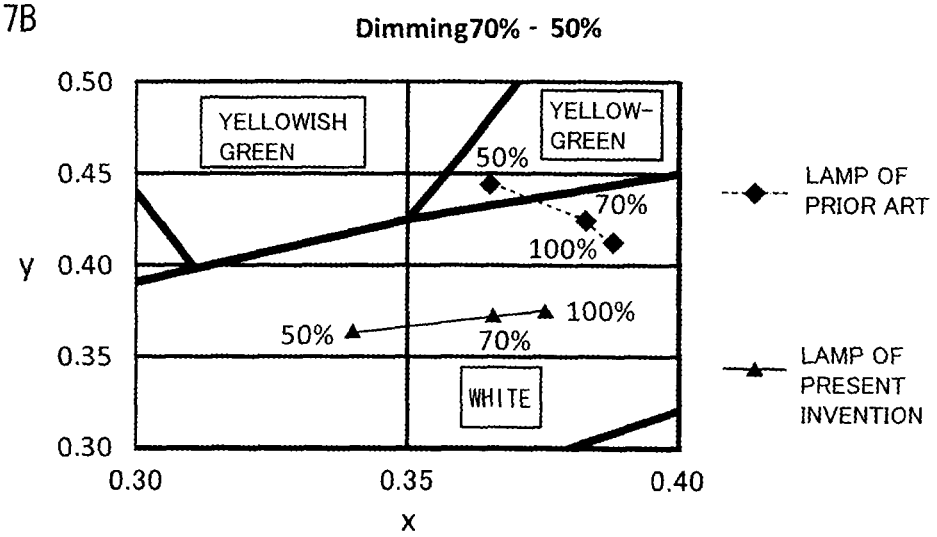
FIG. 7B is an explanatory diagram to which reference will be made in explaining a typical example of dimming in a high-intensity discharge lamp according to an embodiment of the present invention.

FIG. 7B is a diagram showing the prior-art example and only the inventive example 14 extracted from and the inventive examples 11 to 14 shown in FIG. 7A. When the lamp of the inventive example and the lamp of the prior-art example are compared with each other, it is possible to understand clearly that there is a difference in light color shift from the white region when the lamp is dimmed. The lamps of the inventive examples 11 to 14 are operated at a rated power of 270 W. However, in the embodiment of the present invention, a rated power of the lamp may be selected in a range of 100 to 400 W. When the lamp of the inventive example 14 was operated at a rated power, the bulb wall loading was 19.2 W/cm$^2$. When this inventive lamp was operated at 70% of a rated power, the bulb wall loading was 13.4 W/cm$^2$. Further, when this inventive lamp was operated at 50% of a rated power, the bulb wall loading was 9.6 W/cm$^2$.

In the lamp according to the embodiment of the present invention, when the inventive lamp is operated at a rated power, the bulb wall loading may fall within a range from 15 to 40 W/cm$^2$. When this inventive lamp is operated at 70% of a rated power, the bulb wall loading may fall within a range from 10.5 to 28.0 W/cm$^2$. Further, when this inventive lamp is operated at 50% of a rated power, the bulb wall loading may fall within a range from 7.5 to 20.0 W/cm$^2$.

Figure 8A:
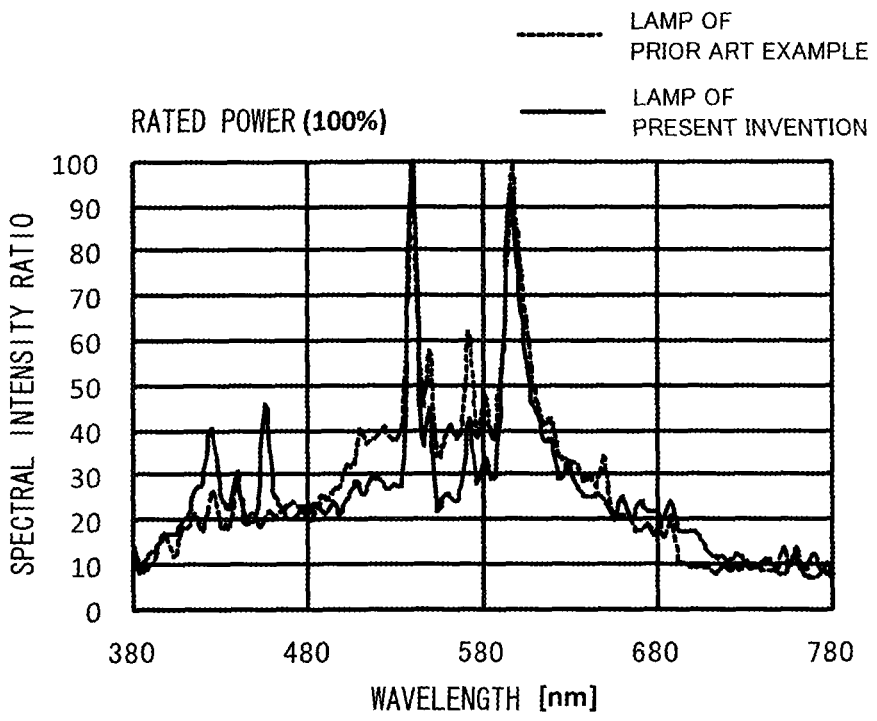
FIG. 8A is an explanatory diagram to which reference will be made in explaining optical spectrums of wavelengths of lights when a high-intensity discharge lamp according to an embodiment of present invention is operated at a rated power.
Figure 8B:
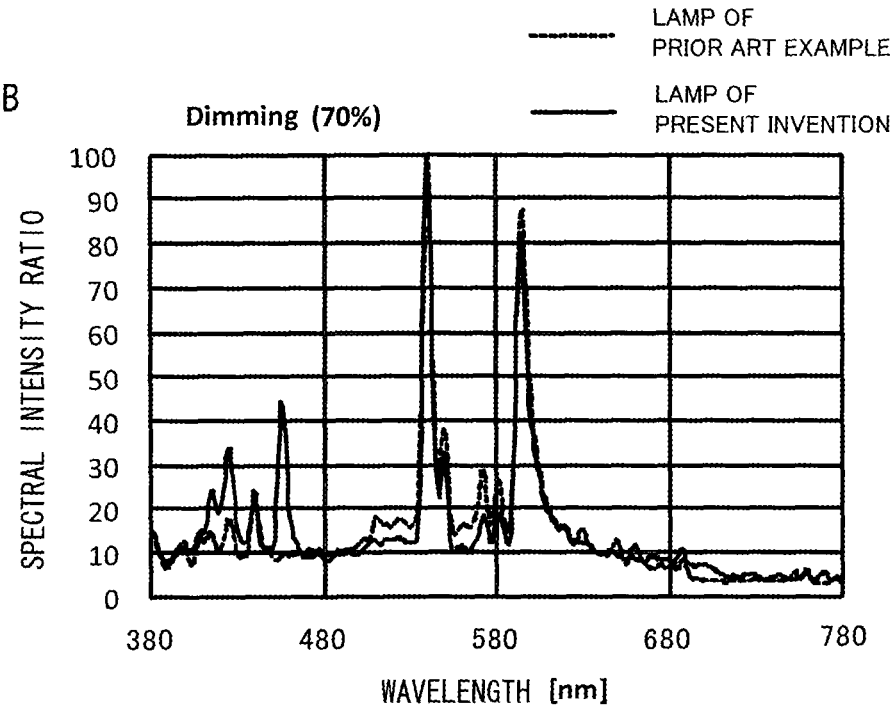
FIG. 8B is an explanatory diagram to which reference will be made in explaining optical spectrums of wavelengths of lights when the high-intensity discharge lamp according to an embodiment of the present invention is operated at 70% of a rated power.
Figure 8C:
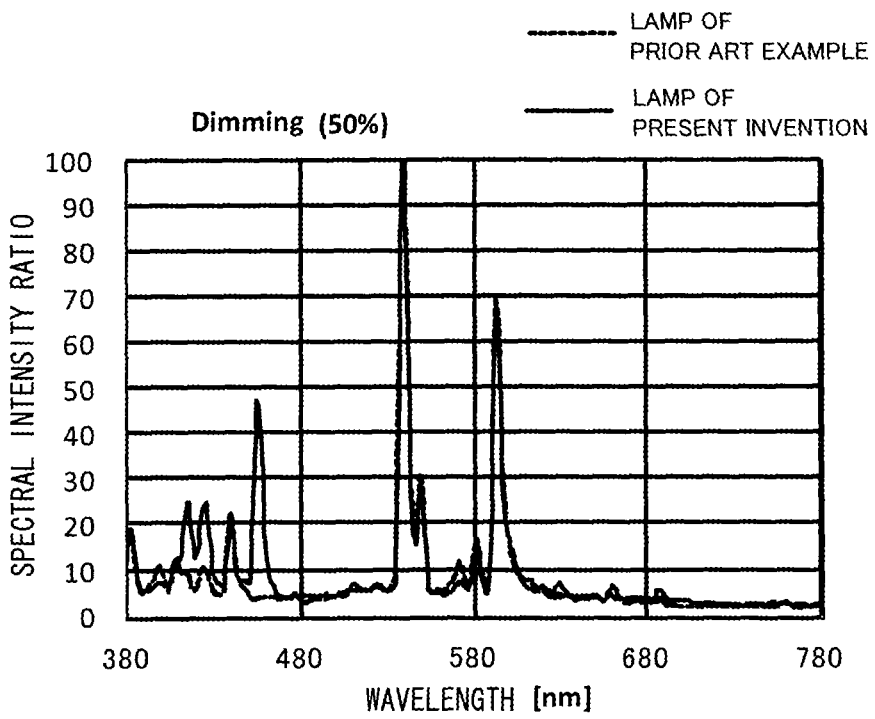
FIG. 8C is an explanatory diagram to which reference will be made in explaining optical spectrums of wavelengths of lights when the high-intensity discharge lamp according to an embodiment of the present invention is operated at 50% of a rated power.

FIG. 8A is a diagram showing wavelength spectrums obtained when lamps are operated at a rated power (100%). FIGS. 8B and 8C are diagrams showing wavelength spectrums obtained when lamps are operated at 70% of a rated power and lamps are operated at 50% of a rated power, respectively. Solid-line curves show wavelength spectrums of the lamps according to the embodiments of the present invention. Broken-line curves show wavelength spectrums of the lamps of the prior-art examples. In these diagrams, a horizontal axis indicates a wavelength [nm] and a vertical axis indicates a spectral intensity ratio [arbitrary unit].

The solid-line curves have two wavelength peaks in the region of wavelengths of 380 to 480 nm respectively. These two wavelength peaks indicate dysprosium Dy having a luminescence peak in the blue region (wavelength near 421 nm) and indium In having a luminescence peak in the blue region (wavelength near 450 nm). These wavelength peaks may not appear in the broken-line curves. The reason for this is that the lamp according to the prior-art example does not contain dysprosium Dy and indium In. Since the lamps according to the inventive examples contain dysprosium Dy and indium In, light color shift to the green region can be suppressed.

Also, the solid-line curves have one wavelength peak in the region of wavelengths of 480 to 580 nm respectively. This wavelength peak indicates thallium Tl having a luminescence peak in the green region (wavelength near 535 nm). The solid-line curves have a wavelength peak in the region of wavelengths of 580 to 680 nm respectively. This wavelength peak indicates sodium Na.

Based on the wavelength spectrums of the lamps shown in FIGS. 8A to 8C, functions of the luminous materials earnestly studied by the inventors of the present application can be explained. A high-intensity discharge lamp may use thallium Tl in order to obtain high lamp efficacy. However, thallium Tl becomes an important factor which causes light color shift to the green region when the lamp is dimmed. Therefore, in order to cancel out green, the inventors of the present application have earnestly examined luminous materials which can produce lights of colors complementary to green. To this end, the inventors of the present application have paid attention to dysprosium Dy having a luminescence peak in the blue region (wavelength near 421 nm) and indium In having a luminescence peak in the blue region (wavelength near 450 nm). Further, the inventors of the present application have paid attention to thulium Tm which has a function to improve lamp efficacy and to enhance color rendering property. However, thulium Tm has a large number of luminescence peaks in the blue-green region (wavelength near 450 to 530 nm) and hence the inventors of the present application have considered that thulium may not have a function to cancel out green. The inventors of the present application have carried out the experiments to obtain appropriate amounts of thallium iodide, dysprosium iodide, indium iodide and the like by varying the amounts thereof.

While the high-intensity discharge lamps according to the embodiments of the present invention have been described so far, these high-intensity discharge lamps have been explained by way of example and do not limit the scope of the present invention. Addition, deletion, variation and improvement made on the embodiments of the present invention by those skilled in the art may fall within the scope of the present invention. A technical scope of the present invention may be determined by the descriptions of the attached claims.

REFERENCE SIGNS LIST

1 . . . ceramic metal-halide lamp, 3 . . . discharge tube, 3A, 3B . . . capillary, 3C . . . light-emitting portion, 5A, 5B . . . electrode, 6A, 6B . . . electrode assembly, 7A, 7B . . . power supply lead wire, 9A, 9B . . . external terminal, 12 . . . base, 13 . . . outer tube, 14 . . . stem, 15, 16 . . . supports, 17A, 17B . . . support disks, 18 . . . translucent sleeve, 19A, 19B . . . nickel wires, 20 . . . getter

The invention claimed is:

1. A ceramic metal-halide lamp including a single translucent ceramic discharge tube in which mercury, a luminous material, and a starting gas are sealed and a translucent outer tube for housing therein said discharge tube, characterized in that said luminous material contains sodium iodide NaI, cerium iodide $CeI_3$, thallium iodide TlI, dysprosium iodide $DyI_3$ and indium iodide InI, assuming that $D[DyI_3]$ represents the amount of said dysprosium iodide $DyI_3$, then the amount is expressed by the following equation:

$$0.07\ \text{mg/cm}^3 \leq D[DyI_3] \leq 1.53\ \text{mg/cm}^3;$$

assuming that R[InI/TlI] represents a weight ratio of indium iodide InI relative to thallium iodide TlI contained in said luminous material, then said weight ratio is expressed by the following equation:

$$0 < R[InI/TlI] \leq 0.23;$$

said luminous material prevents light color shift from the white region when the ceramic metal-halide lamp is dimmed;

said lamp has a rated power of 100 to 400 W and said lamp has a bulb wall loading of 15 to 40 W/cm$^2$, assuming that L represents an effective length of said discharge tube and ID represents an effective inner diameter of said discharge tube, then a ratio L/ID of said effective length to said inner diameter is selected in a range of:

$$1.8 \leq L/ID \leq 2.3;\ \text{and}$$

when said lamp is operated at 70% of a rated power, the bulb wall loading of said lamp falls in a range of 10.5 to 28.0 W/cm$^2$ and when said lamp is operated at 50% of a rated power, the bulb wall loading of said lamp falls in a range of 7.5 to 20.0 W/cm$^2$.

2. The ceramic metal-halide lamp according to claim 1, characterized in that said weight ratio R[InI/TlI] of indium iodide Inl relative to thallium iodide TlI contained in said luminous material is expressed by the following equation:

$$0.05 \leq R[InI/TlI] \leq 0.23.$$

3. The ceramic metal-halide lamp according to claim 1, characterized in that assuming that D[NaI] represents the amount of sodium iodide NaI, $D[CeI_3]$ represents the amount of cerium iodide $CeI_3$ and D[TlI] represents thallium iodide TlI contained in said luminous material, then the amounts are expressed by the following equations:

$$0.70\ \text{mg/cm}^3 \leq D[NaI] \leq 1.73\ \text{mg/cm}^3$$

$$0.15\ \text{mg/cm}^3 \leq D[CeI_3] \leq 0.29\ \text{mg/cm}^3$$

$$0.15\ \text{mg/cm}^3 \leq D[TlI] \leq 0.26\ \text{mg/cm}^3.$$

4. The ceramic metal-halide lamp according to claim 1, characterized in that said luminous material contains calcium iodide $CaI_2$.

5. The ceramic metal-halide lamp according to claim 2, characterized in that assuming that D[NaI] represents the amount of sodium iodide NaI, $D[CeI_3]$ represents the amount of cerium iodide $CeI_3$ and D[TlI] represents thallium iodide TlI contained in said luminous material, then the amounts are expressed by the following equations:

$$0.70\ \text{mg/cm}^3 \leq D[NaI] \leq 1.73\ \text{mg/cm}^3$$

$$0.15\ \text{mg/cm}^3 \leq D[CeI_3] \leq 0.29\ \text{mg/cm}^3$$

$$0.15\ \text{mg/cm}^3 \leq D[TlI] \leq 0.26\ \text{mg/cm}^3.$$

6. The ceramic metal-halide lamp according to claim 2, characterized in that said luminous material contains calcium iodide $CaI_2$.

* * * * *